US008379008B2

(12) United States Patent
Park et al.

(10) Patent No.: US 8,379,008 B2
(45) Date of Patent: Feb. 19, 2013

(54) ORGANIC LIGHT EMITTING DISPLAY DEVICE AND POWER SUPPLY UNIT FOR THE SAME

(75) Inventors: Jung-Kook Park, Suwon-si (KR); Sang-Wook Kim, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 1672 days.

(21) Appl. No.: 11/737,646

(22) Filed: Apr. 19, 2007

(65) Prior Publication Data

US 2007/0269168 A1 Nov. 22, 2007

(30) Foreign Application Priority Data

May 16, 2006 (KR) ..... 10-2006-0043950

(51) Int. Cl.
*G06F 3/038* (2006.01)
*G09G 5/00* (2006.01)

(52) U.S. Cl. ..... 345/211; 345/1.1; 345/76; 345/82

(58) Field of Classification Search ..... 345/1.1–3.4, 345/76–81, 211–212
See application file for complete search history.

(56) References Cited

U.S. PATENT DOCUMENTS

| | | | | |
|---|---|---|---|---|
| 7,365,704 | B2 * | 4/2008 | Wang et al. | 345/1.2 |
| 7,573,438 | B2 * | 8/2009 | Nohara | 345/1.1 |
| 7,808,496 | B2 * | 10/2010 | Woo et al. | 345/211 |
| 7,889,190 | B2 * | 2/2011 | Woo | 345/212 |
| 2004/0183745 | A1 * | 9/2004 | Choi | 345/1.1 |
| 2004/0252096 | A1 | 12/2004 | Wang et al. | |
| 2005/0030254 | A1 * | 2/2005 | Jung et al. | 345/1.1 |
| 2005/0253773 | A1 | 11/2005 | Sekiguchi | |
| 2005/0264471 | A1 * | 12/2005 | Yamazaki et al. | 345/1.1 |
| 2006/0017666 | A1 * | 1/2006 | Kim et al. | 345/76 |
| 2006/0267973 | A1 * | 11/2006 | Woo et al. | 345/211 |
| 2006/0284864 | A1 * | 12/2006 | Woo | 345/211 |

FOREIGN PATENT DOCUMENTS

| | | | |
|---|---|---|---|
| CN | 1246194 | A | 3/2000 |
| CN | 1336629 | A | 2/2002 |
| CN | 1497510 | A | 5/2004 |
| EP | 1 619 653 | A2 | 1/2006 |
| JP | 2002-320006 | | 10/2002 |
| JP | 2004-109595 | | 4/2004 |
| JP | 2005-183006 | | 7/2005 |
| JP | 2005-316139 | | 11/2005 |
| JP | 2005-332914 | | 12/2005 |

(Continued)

OTHER PUBLICATIONS

"269 ICs" 1983, Elektor-Verlag, Aachen, pp. 62,67.

(Continued)

*Primary Examiner* — Michael Pervan
(74) *Attorney, Agent, or Firm* — Christie, Parker & Hale, LLP

(57) ABSTRACT

An organic light emitting display device and a power supply for the same. In one embodiment, an organic light emitting display device includes a first module and a second module, each including an organic light emitting display panel and a driving source. A power supply is for supplying a first driving voltage to the first module and a second driving voltage to the second module. A controller is for applying a common control signal and a data signal to the first module and the second module and for applying a selection signal for selecting at least one of the first module or the second module.

16 Claims, 4 Drawing Sheets

FOREIGN PATENT DOCUMENTS

| | | |
|---|---|---|
| JP | 2006-011387 | 1/2006 |
| JP | 2006-047932 | 2/2006 |
| JP | 2006-201755 | 8/2006 |

OTHER PUBLICATIONS

European Search Report dated Aug. 7, 2008, for corresponding European Application No. 07 108 341.4.

European Search Report dated Sep. 3, 2007 for European Patent Application No. 07108341.4-2205.

SIPO Office action dated Jan. 29, 2010, with English translation, corresponding to Chinese application 200710103843.4.

SIPO Office action dated Aug. 20, 2010, for corresponding Chinese Patent application 200710103843.4.

Japanese Office action dated Aug. 31, 2010, for corresponding Japanese Patent application 2007-111396.

Japanese Office action dated Oct. 25, 2011, for corresponding Japanese Patent application 2007-111396, 2 pages.

* cited by examiner

ORGANIC LIGHT EMITTING DISPLAY DEVICE AND POWER SUPPLY UNIT FOR THE SAME

CROSS-REFERENCE TO RELATED PATENT APPLICATION

This application claims priority to and the benefit of Korean Patent Application No. 10-2006-0043950, filed on May 16, 2006, in the Korean Intellectual Property Office, the entire content of which is incorporated herein by reference.

BACKGROUND OF THE INVENTION

1. Field of the Invention

The present invention relates to an organic light emitting display device and a power supply for the same.

2. Description of the Related Art

Recently, self-emitting light display devices have received considerable attention. In particular, organic light emitting display devices have attracted much attention. The organic light emitting display devices include pixels corresponding to organic light emitting devices which emit light when an electric field is applied thereto.

FIG. 1 is a schematic structural view of a conventional organic light emitting device 1. FIG. 2 is an equivalent circuit diagram of the conventional organic light emitting device 1.

Referring to FIGS. 1 and 2, the organic light emitting device 1 is formed by sequentially stacking a transparent electrode 102 which operates as anode, an organic transport layer 104 and an organic phosphor layer 103, both of which include organic compounds, and a metal electrode 101 which operates as a cathode.

A glass substrate 105 is formed on an opposite side of the transparent electrode 102. A voltage from a driving source 106 is applied between the metal electrode 101 and the transparent electrode 102. Electrons generated by the metal electrode 101 and holes generated by the transparent electrode 102 are recombined to generate excitons. When the excitons are discharged, light is concurrently emitted. The light is emitted through the transparent electrode 102 and the glass substrate 105 to the outside of the organic light emitting device 1. Since the organic light emitting device 1 is formed by stacking an organic phosphor layer (or the like) between electrodes, an equivalent circuit of the organic light emitting device 1 has a parasitic capacitance. That is, as illustrated in FIG. 2, the equivalent circuit diagram of the organic light emitting device 1 includes a luminous body (or a light emitting element) D and a parasitic capacitance C connected in parallel with each other.

FIG. 3 is a schematic circuit diagram of a conventional organic light emitting display device.

Referring to FIG. 3, the conventional organic light emitting display device includes an organic light emitting display panel 2 including a plurality of organic light emitting devices 1, a controller 21, a scan drive source 6, and a data driving source 5.

In the organic light emitting display panel 2, data lines D1, D2, . . . , Dm and scan lines S1, S2, . . . , Sn are formed to cross each other at intervals (which may be predetermined), and organic light emitting devices 1 are formed at the crossing areas of the data lines D1, D2, . . . , Dm and the scan lines S1, S2, . . . , Sn.

The controller 21 processes externally inputted image signals SIM. Data control signals SDA are applied to the data driving source 5, and scan control signals SSC are applied to the scan drive source 6. The data control signals SDA include a data signal. The scan control signals SSC include switching control signals for generating a scan signal. The data driving source 5 is electrically connected to the data lines D1, D2, . . . , Dm and generates a driving current corresponding to the data signal provided by the controller 21 according to the data control signals SDA. Then, the driving current is applied to the data lines D1, D2, . . . , Dm.

The scan drive source 6 is electrically connected to the scan lines S1, S2, . . . , Sn and applies a scan signal to the scan lines S1, S2, . . . , Sn according to the switching control signals.

FIG. 4 is a block diagram illustrating a conventional dual-module organic light emitting display device 400.

Referring to FIG. 4, the conventional dual-module organic light emitting display device 400 includes a first module 401, a second module 403, a first power supplier (or power supply) 405, a second power supplier 407, and a controller 409.

The first and second modules 401 and 403 each include an organic light emitting display panel 2, a data driving source 5, and a scan drive source 6, each of which was previously described with reference to FIG. 3. Since the conventional organic light emitting display device 400 includes two modules, the conventional organic light emitting display device 400 includes the first power supplier 405 and the second power supplier 407 to provide respective powers to the first module 401 and the second module 403. In addition, the controller 409 applies a control signal SC1 and a data signal DATA1 to the first module 401 and a control signal SC2 and a data signal DATA2 to the second module 403. The control signals SC1 and SC2 each include a clock signal, a vertical synchronizing signal, a horizontal synchronization signal, a writing signal, a reading signal, or the like. The data signals DATA1 and DATA2 each include a data driving control signal for controlling the operation of the data driving source 5, and a scan driving control signal for controlling the operation of the scan drive source 6. Selection signals CS1 and CS2 are signals for respectively selecting the first module 401 and the second module 403 or for selecting both of the first module 401 and the second module 403.

According to the dual-module conventional organic light emitting display device 400, the first and second power suppliers 405 and 407 are required, the two control signals SC1 and SC2 should be output from the controller 409, and the two data signals DATA1 and DATA2 should be output from the controller 409. Accordingly, the manufacturing costs and the weight of the organic light emitting display device may be increased.

SUMMARY OF THE INVENTION

Aspects of the present invention respectively provide a dual-module organic light emitting display device and an inexpensive and light power supply for the same.

According to one embodiment of the present invention, an organic light emitting display device includes a first module and a second module, each including an organic light emitting display panel and a driving source. A power supply is for supplying a first driving voltage to the first module and a second driving voltage to the second module. A controller is for applying a common control signal and a data signal to the first module and the second module and for applying a selection signal for selecting at least one of the first module or the second module.

The selection signal of the controller may be adapted to select both the first module and the second module, and the power supply may be adapted to supply a common driving voltage, the common driving voltage being the first driving voltage.

The power supply may include a voltage divider for receiving an input voltage and selectively dividing the input voltage in order to generate the first driving voltage for the first module and the second driving voltage for the second module, and a DC/DC converter for outputting a voltage at a level corresponding to the divided input voltage, wherein the power supply is adapted to supply the voltage output from the DC/DC converter to the first module and the second module.

The voltage divider may include a first resistor for receiving the input voltage at a first end of the first resistor, a second resistor and a third resistor, each being connected in series to the first resistor at a second end of the first resistor, and the third resistor being connected between the first resistor and a ground terminal, and a first switch connected between the second resistor and the ground terminal and adapted to be turned on by the selection signal.

When the first switched is turned on, the first driving voltage may be output from the power supply and may be applied to the first module, and, when the first switch is turned off, the second driving voltage may be output from the power supply and may be applied to the second module.

When the selection signal applied from the controller selects both the first module and the second module, the first switch may be turned on and the first driving voltage output from the power supply may be applied to the first module and the second module.

The power supply may further include a first capacitor for smoothing the input voltage.

The power supply may further include a second capacitor for smoothing the output voltage from the power supply.

The first driving voltage and the second driving voltage may be transmitted through a common power line.

According to another embodiment of the present invention, a power supply for an organic light emitting display device includes a voltage divider for receiving an input voltage and selectively dividing the input voltage to generate a first driving voltage for a first module of the organic light emitting display device and a second driving voltage for a second module of the organic light emitting display device, and a DC/DC converter for outputting a voltage at a level corresponding to the divided input voltage, wherein the voltage output from the DC/DC converter is applied to the first module and the second module.

The voltage divider may include a first resistor for receiving the input voltage at a first end of the first resistor, a second resistor and a third resistor, each being connected in series to the first resistor at a second end of the first resistor and the third resistor being connected between the first resistor and a ground terminal, and a first switch connected between the second resistor and the ground terminal and adapted to be turned on by the selection signal.

The power supply may further include a first capacitor for smoothing the input voltage.

The power supply may further include a second capacitor for smoothing the output voltage from the DC/DC converter.

BRIEF DESCRIPTION OF THE DRAWINGS

The above and other features and aspects of the present invention will become more apparent by describing in detail exemplary embodiments thereof with reference to the attached drawings in which.

DETAILED DESCRIPTION

The present invention will now be described more fully with reference to the accompanying drawings, in which exemplary embodiments of the invention are shown. The invention may, however, be embodied in many different forms and should not be construed as being limited to the embodiments set forth herein; rather, these embodiments are provided so that this disclosure will be more thorough and complete, and will more fully convey the concept of the invention to those skilled in the art.

Figure 5:
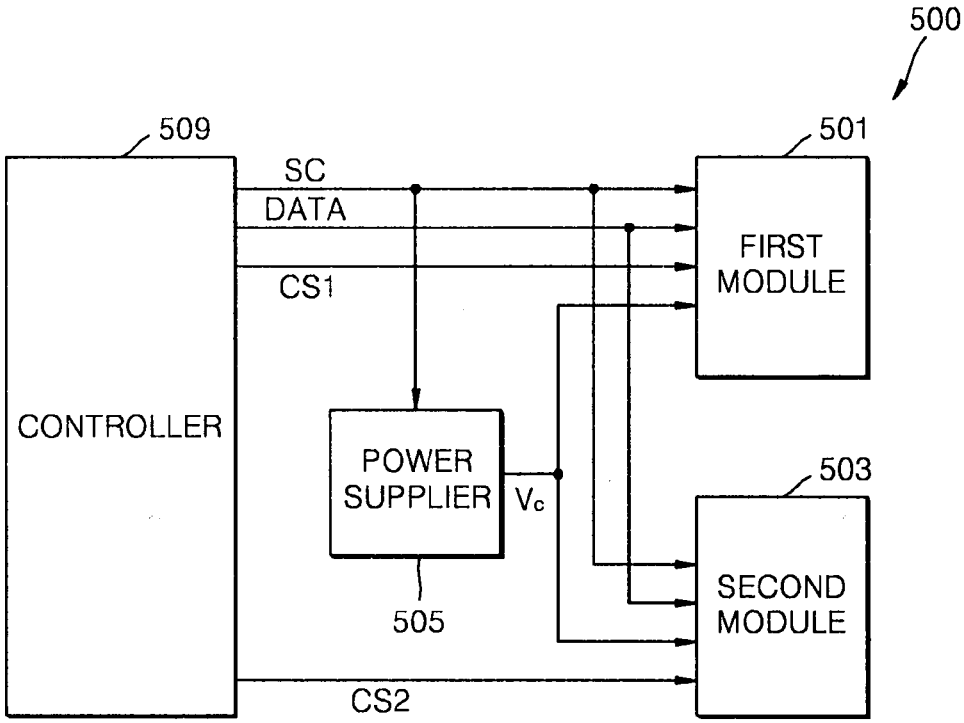
FIG. 5 is a block diagram illustrating an organic light emitting display device according to an embodiment of the present invention.

FIG. 5 is a block diagram illustrating an organic light emitting display device 500 according to an embodiment of the present invention.

Referring to FIG. 5, the organic light emitting display device 500 includes a first module 501, a second module 503, a power supplier (or power supply) 505, and a controller 509.

Figure 1:
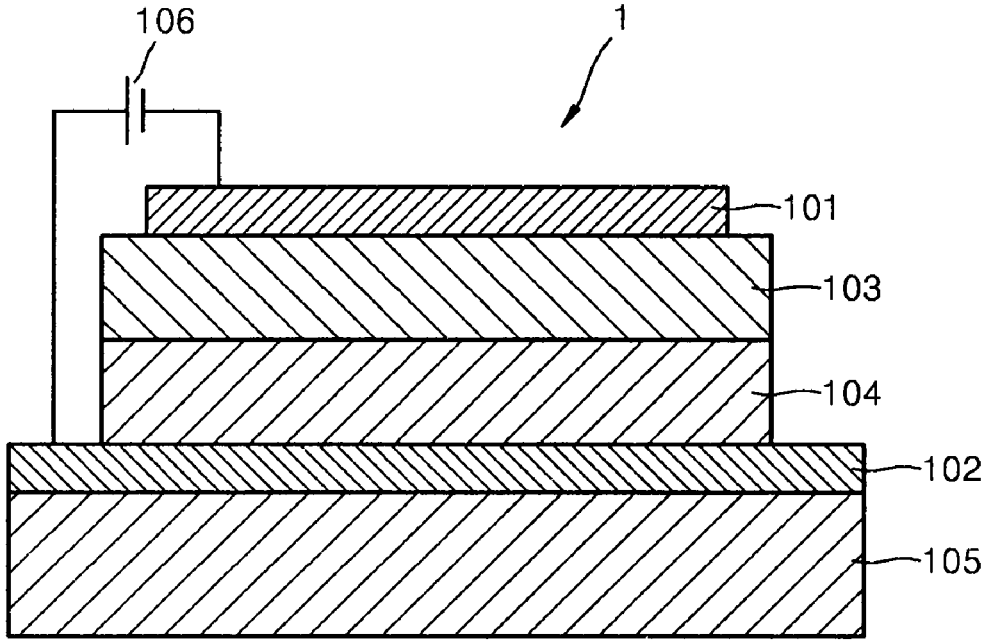
FIG. 1 (PRIOR ART)
FIG. 1 is a schematic structural view of a conventional organic light emitting device.
Figure 2:
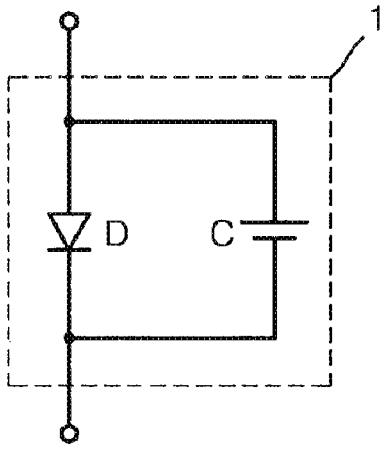
FIG. 2 (PRIOR ART)
FIG. 2 is an equivalent circuit diagram of the conventional organic light emitting device.
Figure 3:
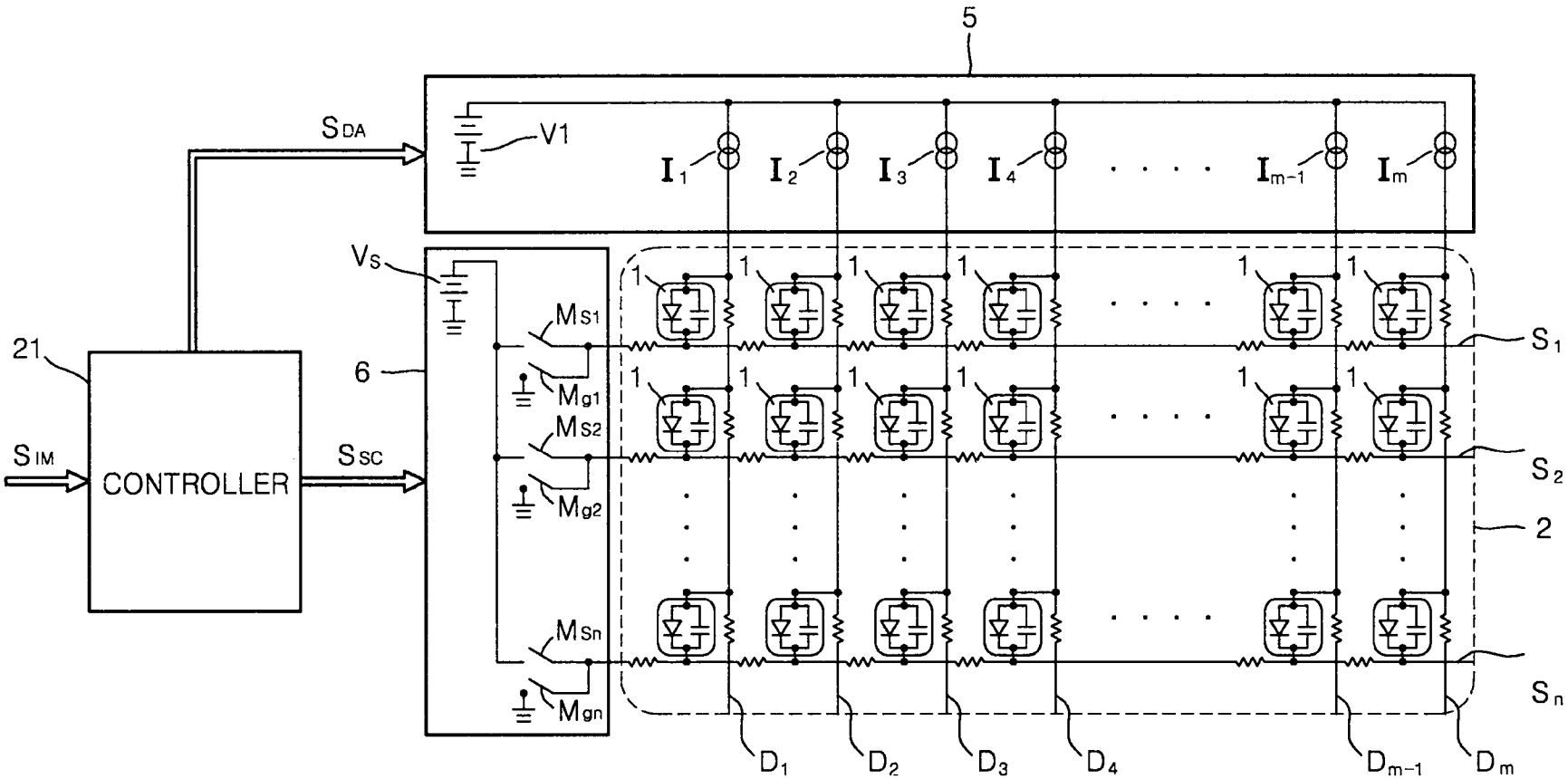
FIG. 3 (PRIOR ART)
FIG. 3 is a schematic circuit diagram of a conventional organic light emitting display device.
Figure 4:
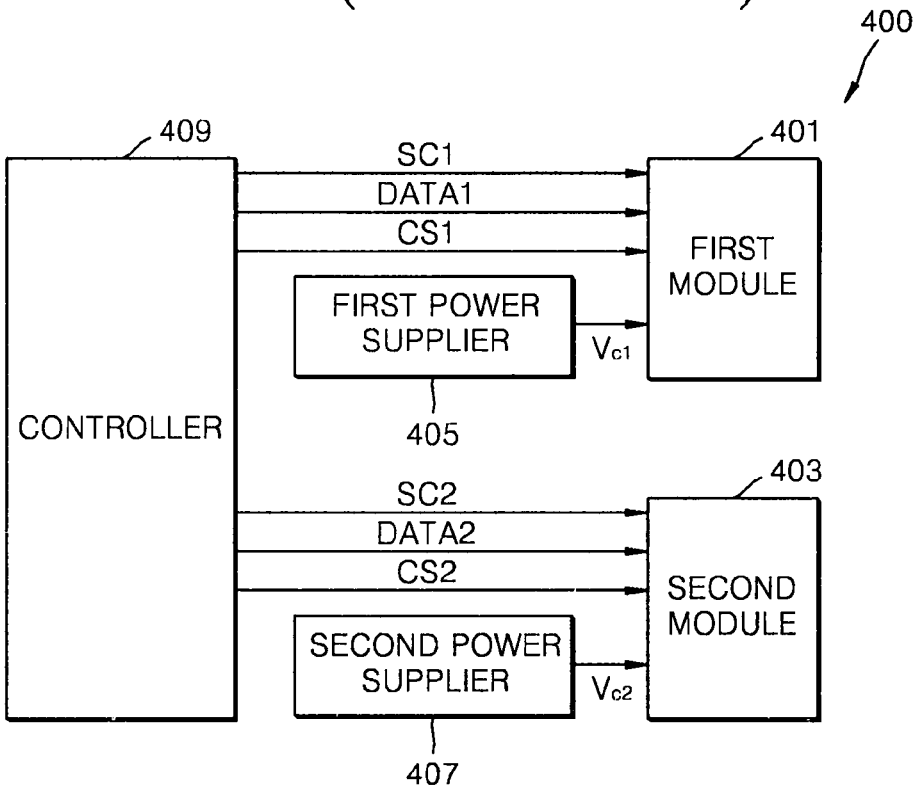
FIG. 4 (PRIOR ART)
FIG. 4 is a block diagram illustrating a conventional dual-module organic light emitting display device.

The first and second modules 501 and 503 each include an organic light emitting display panel 2, a data driving source 5, and a scan drive source 6, each of which was previously described with reference to FIG. 3. Since the conventional organic light emitting display device 400 includes two modules, the organic light emitting display device 400 includes a first power supply (or power supplier) 405 and a second power supply 407 for supplying respective powers to the first module 401 and the second module 403 (see, for example, FIG. 4). However, the organic light emitting display device 500 includes a single power supply 505 rather than two individual power supplies, and thus manufacturing costs may be reduced and the organic light emitting display device 500 may be lighter in weight.

The power supply 505 supplies an output voltage to the first module 501 and the second module 503. The output voltage may be of a first voltage level or a second voltage level, as appropriate for driving the first module 501 or the second module 503, respectively. That is, the power supply 505 effectively generates two driving voltages. The power supply 505 will be described in more detail with reference to FIG. 6.

The controller 509 applies a common control signal SC and a common data signal DATA to the first module 501 and the second module 503. In addition, the controller 509 applies selection signals CS1 and CS2 for selecting the first module 501 and the second module 503, respectively, or for concurrently selecting both the first module 501 and the second module 503, to the first module 501 and the second module 503, respectively. The control signal SC includes a clock signal, vertical synchronizing signal, horizontal synchronization signal, writing signal, reading signal, or the like. The data signal DATA includes a data driving control signal for controlling the operation of the data driving source 5 and a scan driving control signal for controlling the operation of the scan drive source 6. The selection signals CS1 and CS2 are signals for selecting the first module 501 and the second module 503, respectively, or for selecting both the first module 501 and the second module 503. When the selection signal CS1 selects the first module 501, the power supply 505 outputs a first driving voltage. When the selection signal CS2 selects the second module 503, the power supply 505 outputs a second driving voltage. When the selection signals CS1 and CS2 concurrently select both the first module 501 and the second module 503, the power supply 505 may supply the first driving voltage (as a common driving voltage).

In the organic light emitting display device 500, the first driving voltage and the second driving voltage, which are selectively output from the power supply 505 respectively to the first module 501 and the second module 503, may be applied through a common power line. The control signal SC and the data signal DATA are applied to the first module 501 and the second module 503. The control signal SC and the data signal DATA may be applied through a common control line and a common data line, respectively.

Figure 6:
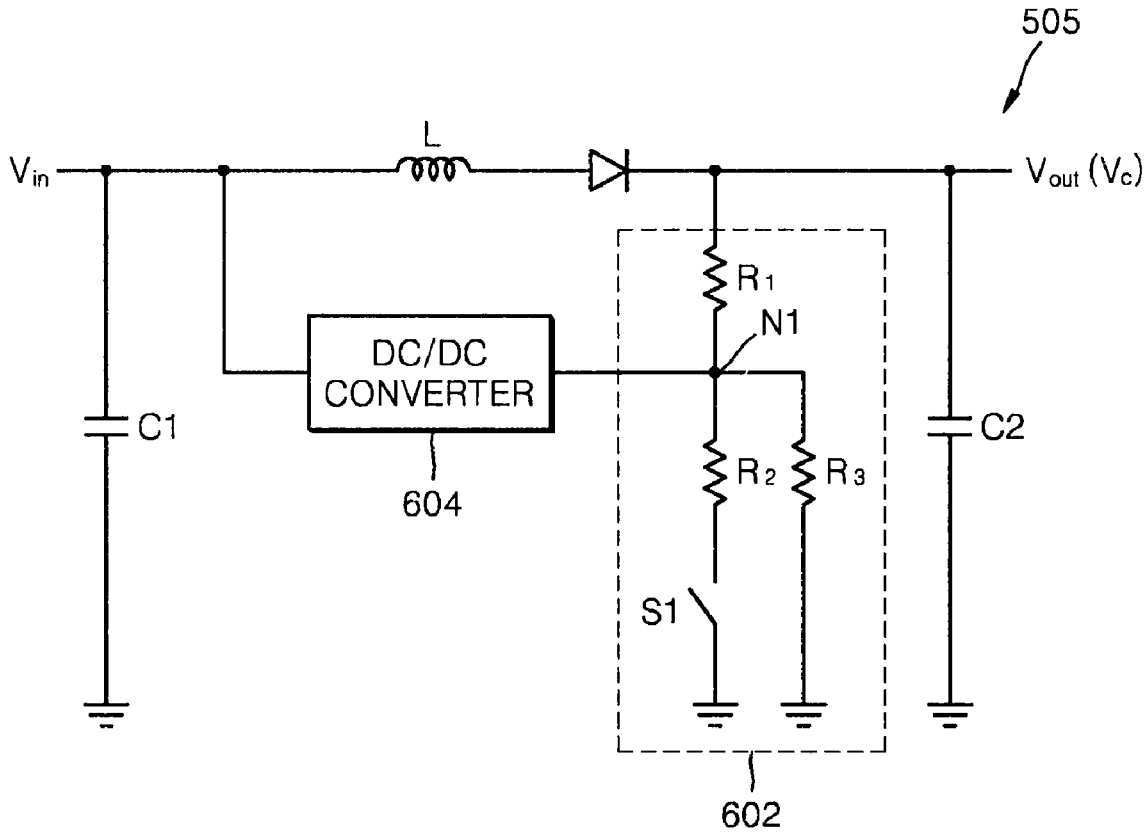
FIG. 6 is a circuit diagram of a power supply, according to an embodiment of the present invention.

FIG. 6 is a circuit diagram of the power supply 505, according to an embodiment of the present invention.

Referring to FIG. 6, the power supply 505 includes a first capacitor C1, an inductor L, a voltage divider 602, a DC/DC converter 604, and a second capacitor C2.

The first capacitor C1 is for smoothing (or filtering) an input voltage Vin. The smoothed input voltage Vin is output as an output voltage Vout through the inductor L, which is a current storage device, and a diode. Here, the output voltage Vout is smoothed by the second capacitor C2. The output voltage Vout is a voltage which is smoothed by the second capacitor C2 and then output from the power supply 505.

The voltage divider 602 selectively divides the output voltage Vout, which is transmitted though the inductor L and the diode, according to the control signal SC. To achieve this, the voltage divider 602 includes a first resistance (or resistor) R1, a second resistance R2 and a third resistance R3, each of which is connected in series to the first resistance R1, and a first switch S1 arranged between the second resistance R2 and ground. One end of the third resistance R3 is connected to ground. The first switch S1 is turned on to connect the second resistance R2 and ground, thereby connecting the second resistance R2 and the third resistance R3 in parallel with each other.

According to the structure of the voltage divider 602, when the first switch S1 is turned on, that is, when the control signal SC selects the first module 501, a divided voltage (Vout/[1+R1/(R2//R3)]) due to a resulting parallel connection of the second resistance R2 and the third resistance R3 is transmitted to a DC/DC converter 604 upon feedback. The DC/DC converter 604 converts a voltage level of the divided voltage (Vout/[1+R1/(R2//R3)]), and then again transmits the divided voltage (Vout/[1+R1/(R2//R3)]) to the inductor L.

When the first switch S1 is turned off, that is, when the control signal SC selects the second module 503, the second resistance R2 is not connected in parallel to the third resistance R3 any more. Thus, the divided voltage (Vout/[1+R1/R3]) is transmitted to the DC/DC converter 604 upon feedback. The DC/DC converter 604 converts a voltage level of the divided voltage (Vout/[1+R1/R3]), and then again transmits the divided voltage (Vout/[1+R1/R3]) to the inductor L.

When the control signal SC selects the first module 501, a higher output voltage is output from the power supply 505 relative to the case where the control signal SC selects the second module 503 due to the type of voltage division. A first driving voltage is a voltage output from the power supply 505 in order to drive the first module 501. A second driving voltage is a voltage output from the power supply 505 in order to drive the second module 503. In the organic light emitting display device 500 including two modules, the first module 501 may be a main module, and the second module 503 may be a sub module. Thus, by way of example, the first driving voltage of the first module 501 may be about 18 V, and the second driving voltage of the second module 503 may be about 14 V.

When the control signal SC selects both of the first module 501 and the second module 503, both of the selection signals CS1 and CS2 are applied to the first module 501 and the second module 503, respectively. Here, the power supply 505 concurrently supplies the first driving voltage higher than the second driving voltage to the first module 501 and the second module 503. This is because when the power supply 505 supplies the second driving voltage lower than the first driving voltage to the first module 501 and the second module 503, the first module 501 may not operate normally.

The first driving voltage and the second driving voltage, which is output from the power supply 505 to the first module 501 and the second module 503, respectively, may be transmitted through a common power line.

The present invention has the following features.

In the organic light emitting display device using two modules, the power supply supplies two different driving voltages, and thus the manufacturing costs and the weight of the organic light emitting display device can be decreased.

In addition, since the organic light emitting display device using two modules commonly uses a common power line, a common control line for transferring a control signal, and a common data line for transferring a data signal, the manufacturing costs of the organic light emitting display device can be decreased.

While the present invention has been particularly shown and described with reference to exemplary embodiments thereof, it will be understood by those of ordinary skill in the art that various changes in form and details may be made therein without departing from the spirit and scope of the present invention as defined by the following claims and their equivalents.

What is claimed is:

1. An organic light emitting display device comprising:

a first module and a second module, each comprising an organic light emitting display panel and a driving source;

a controller for applying a common control signal and a data signal to the first module and the second module and for applying a selection signal for selecting at least one module to be activated from among the first module and the second module; and a power supply for supplying a first driving voltage to the first module as a first power when the first module is selected and the second module is not selected, and for supplying a second driving voltage to the second module as the first power when the second module is selected and the first module is not selected, wherein the power supply comprises:

a voltage divider for receiving an input voltage and selectively dividing the input voltage in order to generate the first driving voltage for the first module and the second driving voltage for the second module; and a DC/DC converter for outputting a voltage at a level corresponding to the divided input voltage, wherein the power supply is adapted to supply the voltage output from the DC/DC converter to the first module and the second module, and wherein when the selection signal of the controller is adapted to select both the first module and the second module, the power supply is adapted to supply a common driving voltage to both the first module and the second module as the first power.

2. The organic light emitting display device of claim 1, wherein the voltage divider comprises:

a first resistor for receiving the input voltage at a first end of the first resistor;

a second resistor and a third resistor, each being connected in series to the first resistor at a second end of the first resistor, and the third resistor being connected between the first resistor and a ground terminal; and a first switch connected between the second resistor and the ground terminal and adapted to be turned on by the selection signal.

3. The organic light emitting display device of claim 2, wherein, when the first switch is turned on, the first driving voltage is output from the power supply and is applied to the first module, and, when the first switch is turned off, the second driving voltage is output from the power supply and is applied to the second module.

4. The organic light emitting display device of claim 3, wherein, when the selection signal applied from the controller selects both the first module and the second module, the first switch is turned on and the first driving voltage output from the power supply is applied to the first module and the second module.

5. The organic light emitting display device of claim 1, wherein the power supply further comprises a first capacitor for smoothing the input voltage.

6. The organic light emitting display device of claim 5, wherein the power supply further comprises a second capacitor for smoothing the output voltage from the power supply.

7. The organic light emitting display device of claim 1, wherein the power supply further comprises a second capacitor for smoothing the output voltage from the power supply.

8. A power supply for an organic light emitting display device, the power supply comprising:

a voltage divider for receiving an input voltage and selectively dividing the input voltage to generate a first driving voltage for a first module of the organic light emitting display device and a second driving voltage for a second module of the organic light emitting display device; and a DC/DC converter for outputting a voltage at a level corresponding to the divided input voltage, wherein the voltage output from the DC/DC converter is applied to at least one of the first module or the second module as a first power according to a selection signal for selecting an activation of at least one module from among the first module and the second module, and wherein when the selection signal is adapted to select both the first module and the second module, the voltage divider is adapted to generate a common driving voltage, and to apply the common driving voltage to both the first module and the second module as the first power.

9. The power supply of claim 8, wherein the voltage divider comprises:

a first resistor for receiving the input voltage at a first end of the first resistor;

a second resistor and a third resistor, each being connected in series to the first resistor at a second end of the first resistor and the third resistor being connected between the first resistor and a ground terminal; and a first switch connected between the second resistance and the ground terminal and adapted to be turned on by the selection signal.

10. The power supply of claim 8, further comprising a first capacitor for smoothing the input voltage.

11. The power supply of claim 10, further comprising a second capacitor for smoothing the output voltage from the DC/DC converter.

12. The power supply of claim 8, further comprising a second capacitor for smoothing the output voltage from the DC/DC converter.

13. The power supply of claim 8, wherein when the first module is selected and the second module is not selected, the power supply supplies the first driving voltage to the first module, and when the second module is selected and the first module is not selected, the power supply supplies the second driving voltage to the second module, and wherein the common driving voltage is a higher one of the first driving voltage and the second driving voltage.

14. An organic light emitting display device comprising:

a first module and a second module, each comprising an organic light emitting display panel;

means for generating a first driving voltage which is applied to the first module as a first power when the first module is selected and the second module is not selected, and a second driving voltage which is applied to the second module as the first power when the second module is selected and the first module is not selected; and means for applying a common control signal and a data signal to the first module and the second module and for applying a selection signal for selecting at least one of the first module or the second module, wherein the means for generating comprises a voltage divider for receiving an input voltage and for producing a reduced voltage according to the selection signal, wherein, according to a first selection of the selection signal, the reduced voltage of the voltage divider corresponds to a first resistance, wherein, according to a second selection of the selection signal, the reduced voltage of the voltage divider corresponds to a second resistance, the second resistance being lower than the first resistance, and wherein when the selection signal is adapted to select both the first module and the second module, the means for generating is adapted to supply a common driving voltage to the first module and the second module as the first power.

15. The organic light emitting display device of claim 14, wherein the means for generating further comprises a first capacitor for smoothing the input voltage.

16. The organic light emitting display device of claim 15, wherein the means for generating further comprises a second capacitor for smoothing one of the first driving voltage or the second driving voltage.

* * * * *